US012310484B2

(12) United States Patent
Bianco

(10) Patent No.: US 12,310,484 B2
(45) Date of Patent: May 27, 2025

(54) COSMETIC APPLICATOR WITH SEPARATELY FORMED SURFACES

(71) Applicant: Toly Management Ltd., Zejtun (MT)

(72) Inventor: Dorien Bianco, Zejtun (MT)

(73) Assignee: Toly Management Ltd., Zejtun (MT)

( * ) Notice: Subject to any disclaimer, the term of this patent is extended or adjusted under 35 U.S.C. 154(b) by 427 days.

(21) Appl. No.: 16/876,959

(22) Filed: May 18, 2020

(65) Prior Publication Data

US 2020/0367631 A1 Nov. 26, 2020

(30) Foreign Application Priority Data

May 22, 2019 (IN) ..... 201911020359

(51) Int. Cl.

| | |
|---|---|
| ***A45D 34/04*** | (2006.01) |
| ***A45D 33/00*** | (2006.01) |
| ***A45D 40/26*** | (2006.01) |
| *A46B 9/02* | (2006.01) |

(52) U.S. Cl.

CPC ..... *A45D 40/265* (2013.01); *A45D 33/00* (2013.01); *A45D 34/043* (2013.01); *A45D 34/045* (2013.01); *A45D 34/046* (2013.01); *A45D 40/264* (2013.01); *A45D 40/267* (2013.01); *A46B 9/021* (2013.01); *A46B 2200/1046* (2013.01); *A46B 2200/1053* (2013.01)

(58) Field of Classification Search

CPC ..... A46B 5/0012; A46B 2200/1053; A45D 34/043; A45D 34/042; A45D 34/045; A45D 40/262; A45D 40/265

See application file for complete search history.

(56) References Cited

U.S. PATENT DOCUMENTS

| | | | | |
|---|---|---|---|---|
| 5,007,442 | A | 4/1991 | Hirzel | |
| 7,665,473 | B1 * | 2/2010 | Gueret | A46D 1/0253 132/218 |
| 9,730,503 | B2 * | 8/2017 | Moon | A45D 40/265 |
| 2008/0006287 | A1 * | 1/2008 | Gueret | A45D 40/265 132/294 |
| 2016/0157586 | A1 * | 6/2016 | Pires | A45D 40/26 401/129 |
| 2017/0290411 | A1 | 10/2017 | Sanchez | |

FOREIGN PATENT DOCUMENTS

| | | |
|---|---|---|
| DE | 202016103629 | 7/2016 |
| EP | 0792602 | 9/1997 |
| EP | 0839472 | 5/1998 |

(Continued)

*Primary Examiner* — Nicholas D Lucchesi

*Assistant Examiner* — Jennifer Gill

(74) *Attorney, Agent, or Firm* — Wissing Miller LLP

(57) ABSTRACT

A cosmetic applicator for applying a cosmetic or care product includes an applicator member retained at a distal end of a stem. The applicator member comprising an applicator head including: a first part having a cavity which is not a through cavity, and a second part that is connected to the first part by a hinge and is at least partially engaged in the housing of the first part. The applicator head defines two opposite main faces and wherein one type of application elements are accessible for use on the first face and a second type of application elements are accessible for use on second face of the applicator head.

11 Claims, 6 Drawing Sheets

(56) References Cited

FOREIGN PATENT DOCUMENTS

| | | | |
|---|---|---|---|
| EP | 1070467 | | 1/2001 |
| EP | 1726235 | | 11/2006 |
| FR | 2955017 | * | 7/2011 |
| FR | 2976162 | | 12/2012 |
| WO | 2008140152 | | 11/2008 |

* cited by examiner

COSMETIC APPLICATOR WITH SEPARATELY FORMED SURFACES

This application claims priority under 35 U.S.C. § 119 to Indian Provisional Patent Application No. 201911020359, filed on May 22, 2019. The disclosure of this application is incorporated herein by reference.

BACKGROUND

Field

The present disclosure relates generally relates to a cosmetic applicator for applying a product including a cosmetic, care or pharmaceutical product, onto keratinous substrate such as skin, lips, under eyes, eyebrows, eyelids, cheeks, nails or any other part of the body. In particular, the disclosure relates to an applicator for cosmetic products with an applicator head that is formed in an interim configuration where different surface treatments can be applied to two spatially separated surfaces and that is folded into an assembled configuration where the two surfaces are brought together to form an applicator head with sides having distinct properties. According to one embodiment, one side of the applicator head can be formed with moulded application elements, for example, polymer tines, and the other side formed as a smooth surface covered with flocked fibers.

Description of the Related Art

Cosmetic applicators such as dip or wand applicators are known in the cosmetic industry. Cosmetic packages often include such applicators for dispensing a particular cosmetic contained in the package reservoir. The cosmetic applicator generally includes a stem with a cap at one end and an applicator head in the form of a brush, spatula or other applicator structure suitable for applying a cosmetic or a care product including viscous cosmetics, mascara, eye liner, lip gloss, hair color, wound care, skin care, under eye cosmetics, pharmaceutical and like products.

European Patent Application FR 2 976 162 discloses a device for treating human keratin materials, in particular the skin, comprising two parts that are fixed together in a removable manner and define two opposite faces of the applicator, making it possible to carry out different treatments. The first face makes it possible for example to apply a cosmetic product and the second face makes it possible to remove, clean off or absorb impurities.

European Patent Applications EP 1 726 235 and EP 0 792 602 disclose cosmetic product applicators that comprise a cavity for holding the product to be applied.

A flocked applicator comprising a housing that holds a foam impregnated with a cosmetic product is known from European Patent Application EP 0 839 472.

European Patent Application EP 1 070 467 discloses an applicator comprising a first part and a second part joined by a hinge and forming a line of teeth disposed alternatively on different side of a separation face.

U.S. Pat. No. 5,007,442 discloses a tong shape apparatus comprising an applicator brush and a comb applicator at the ends of two rods connected by a pivot with a spring action, the spring action forcing the rods to open in absence of external forces.

WO 2008/140152 discloses a curling mascara apparatus comprising an upper tong hinged at an end thereof to a lower tong so as to perform a clamping operation for curling the eyelashes.

French Patent Application FR 2 955 017 discloses an applicator comprising a succession of bristles on a first portion and additional application elements distinct from the bristles on a second portion that may be hinged to the first portion.

There is a need to further improve packaging and application devices and in particular to benefit from a device which is easy to produce and which makes it possible to obtain new treatment or makeup effects.

SUMMARY

According to an embodiment of the present disclosure, there is provided a cosmetic package comprising a cosmetic applicator for applying a product including a cosmetic or a care product or pharmaceutical product onto human skin or keratinous materials, such as, for example, hair, eyebrows, nails and/or eyelashes. The product includes viscous liquid, semisolid or powder product for application on skin of face, eyes etc.

According to an embodiment of the present disclosure, the cosmetic applicator comprises an applicator member comprising an applicator head having two opposite main faces, the applicator head comprising:

- a first part having at least one cavity, and
- a second part that is connected to the first part by a hinge and is at least partially and fixedly engaged in the cavity of the first part,
- wherein only the first part is visible from one of the two main faces and both the first and the second parts are visible from the opposite face of the applicator head.

By "fixedly engaged", it should be understood that in an applicator according to the present disclosure, the second part of the applicator head remains engaged in the cavity of the first part and is not easily movable relative to the latter. No external force for example exerted by a user or by a collar of a container into which the applicator head is inserted is needed for maintaining the engagement.

According to an aspect of the present disclosure, the cosmetic package comprises a container for holding a product and the cosmetic applicator. The cosmetic applicator comprises an applicator member, a stem and a cap. The cap of the applicator has threads which can be screwed onto threads, formed on a neck of the container. A wiper may be provided in the neck of the receptacle for wiping off excess product from the cosmetic applicator.

In the present embodiment, the axis of the stem is rectilinear, but it could be curved in an alternate embodiment.

According to an aspect of the present disclosure, the applicator member is retained at a distal end of the stem for applying the product; and the cap at a proximal end of the stem.

The distal end of the stem includes an interior longitudinal opening or cavity for receiving a mounting end piece of the applicator member.

In the present embodiment, the applicator head extends along a longitudinal axis and is attached to an end piece. The latter is fanned by two half end pieces that are in contact with one another and connected together by the hinge.

Each of two half end pieces are connected to the first part and to the second part respectively of the applicator head. The end piece can be held in the stem by any means, in particular by adhesive bonding, force-fitting, stapling, screw-fastening, crimping or snap-fastening.

In present embodiment, the end piece is in the form of a cylinder of revolution in the case of mounting in a stem. The end piece can be realized in a different manner, in particular when it is intended to serve directly for gripping.

The disclosure affords new possibilities for producing the applicator member, with different surface states and/or different materials on the first and second parts. In particular, the disclosure makes it very easily possible for only one of the parts to be flocked, if so desired, or for them to be flocked differently. Such partial flocking, limited to one of the parts, also gives the applicator an attractive appearance.

According to an aspect of the present disclosure, the first part comprises a plurality of application elements such as tines on its outer surface, and the second part can be flocked. The tines extend preferably perpendicularly relative to the longitudinal axis of the applicator head. In an alternate embodiment, the tines may extend at any other non-zero angle relative to the longitudinal axis of the applicator head. The plurality of application elements is adapted to convey and apply the cosmetic product.

In variant embodiment, the plurality of application elements on the first part may include projections, bristles, particles, ribs, grooves, discs, slits, cuts, holes, dimples, or other molded features that are suitable for combing and/or loading, transporting and applying cosmetic product such as, for example, mascara, eyeshadow etc.

In still other alternate embodiment, the plurality of application elements in form of tines or other molded features may be present on the outer surface of second part of the applicator head and the outer surface of the first part may be flocked.

According to an aspect of the present disclosure, the applicator member comprises two portions namely a first portion and a second portion. The first portion further comprises a first part of the applicator head and a first half end piece; and the second portion further comprises a second part of the applicator head and a second half end piece. The longitudinal axis of the applicator head extends along the longitudinal axis of the end piece. In alternate embodiment, the longitudinal axis of the applicator head forms an angle of preferably less than 45°, better still between 10 and 45°, with the longitudinal axis of the end piece.

Each of the two half end pieces preferably has a flat face, the latter coming into contact with one another over their entire surface area. In a variant embodiment, these faces may comprise one or more reliefs that cooperate, for example by snap-fastening.

In present embodiment, the hinge is a film hinge and is disposed at those ends of the two half end pieces that are away from the first and second parts of the applicator head. It allows the two parts and the two half end pieces to be molded in the open configuration in one piece and to be assembled by the second part and the half end piece being rotated about an axis of the hinge which is perpendicular to a longitudinal axis of the end piece.

Further, the first and second parts can each be attached to a respective half end piece by way of a corresponding intermediate portion which widens in the direction of the associated part. Preferably, the intermediate portions are symmetrical such that when they are folded one over the other, the applicator member has no discontinuities in its portion extending between the end piece and the applicator head.

In present embodiment, the first part of the applicator head comprises of a curved body forming a non-through cavity, for receiving the second part. The cavity is open only on an inner side and along an entire length of the curved body, such that the cavity has an open top end and an open bottom end. The cavity may be in the form of a trough formed by walls.

Further, in the assembled state, the applicator head defines two opposite main faces a first face and a second face.

In the assembled state, when the second part is received in the first part, the first part surrounds the second part in such a way that only an outer surface of the first part is visible on one side of the applicator head, thus forming a first face of the applicator head in front view of the applicator member, and the second face opposite to the first face of the applicator head comprises a combination of an outer surface of the second part and an outer surface of the first part of the applicator head in rear view of the applicator member. According to one embodiment, the walls forming the cavity or trough cover portions of the second part so that only the first part is visible on one side of the applicator head.

Further, one type of application elements, in present case tines are accessible for use on the first face of the applicator head and a second type of application elements, in present case flocked fibers are accessible for use on the second face of the applicator head.

In the present embodiment, the walls forming cavity have edges that are oblique with respect to the longitudinal axis of the applicator head. Therefore, in the assembled state, when the second part is received in the first part, the outer surface of the first part meets the outer surface of the second part at an interface which is at a non-zero angle with respect to the longitudinal axis of the applicator head.

The cavity of the first part of the applicator head has a protrusion and the second part has a corresponding groove. The protrusion and groove form an interlocking structure. One or more such interlocking structures may be provided.

During assembly of the applicator member, the second part is folded over the first part to receive the second part in the first part.

According to one embodiment, during folding of the second part over the first part, the protrusion of the first part is snap-fastened into the groove of the second part and the protrusion of the first intermediate portion is snap-fastened into a corresponding groove in the second intermediate portion in order to keep the applicator member in the closed position.

In alternate embodiments, the second part can comprise a protrusion that is snap-fastened into a groove in the first part, or it is possible for the first and the second part not to have any groove for snap-fastening.

The two portions of the applicator member can be kept in place by the insertion of the applicator member into the longitudinal cavity of the stem. The two half end pieces are then clamped together.

According to an embodiment of the present disclosure, the cosmetic applicator may be fabricated from a material selected from a group consisting of plastic, metal, alloy, ceramic, stone, wood, rubber, sintered or porous material and/or combinations thereof.

The above and other objects, features and advantages of the present disclosure will become clear from the following description of the preferred embodiments when the same is read in conjunction with the accompanying drawings.

Other objects, features, and advantages of the present disclosure will become clear from the following description of the preferred embodiments when the same is read in conjunction with the accompanying drawings.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

Figure 1:
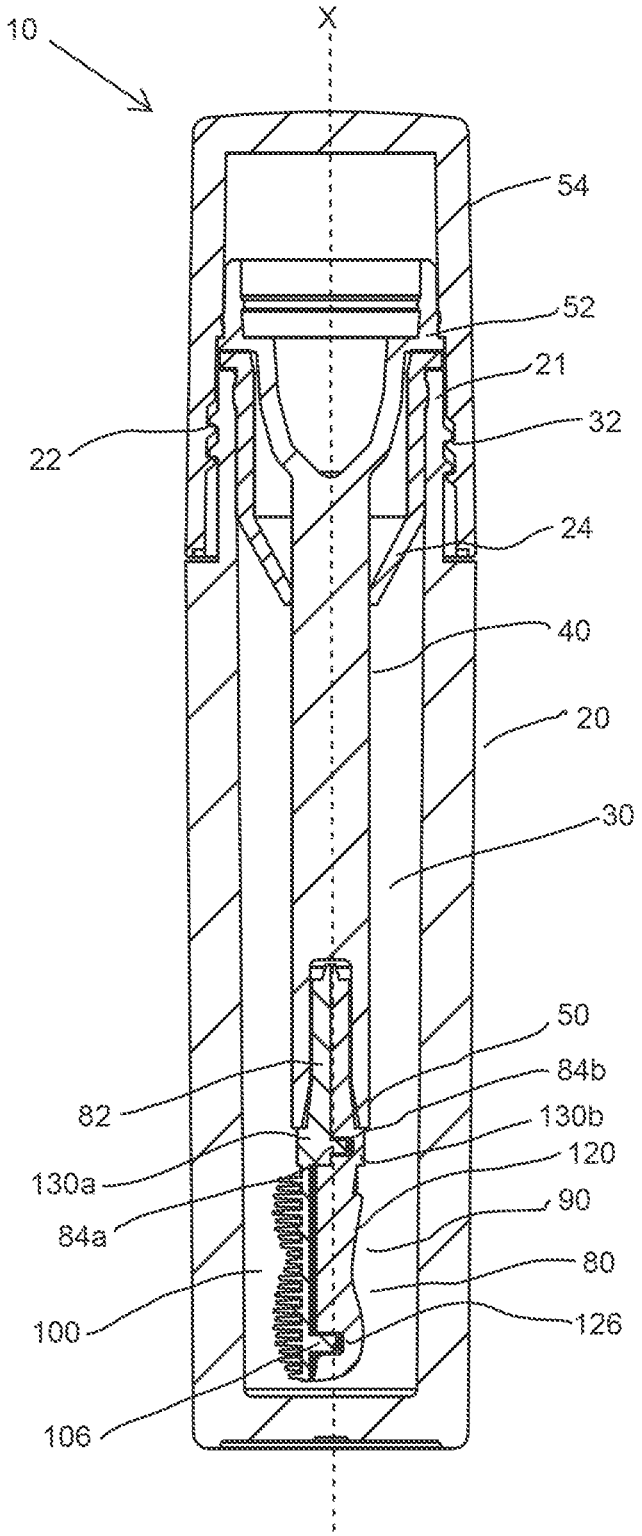
FIG. 1 shows a longitudinal sectional view of a cosmetic package comprising a cosmetic applicator, according to a first embodiment of the present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Throughout this specification, the terms "comprise," "comprises," "comprising" and the like, shall consistently mean that a collection of objects is not limited to those objects specifically recited.

FIG. 1 illustrates a cosmetic package 10 comprising a container 20 containing a product (not shown) to be applied and an applicator 30 for taking up and applying the product contained in the container.

The applicator 30 comprises a stem 40 having a longitudinal axis X, bearing an applicator member 80 at its distal end 50. The applicator member 80 comprising an applicator head 90. As can be seen in FIGS. 2 to 5, the applicator head 90 comprises a first part 100 and a second part 120 that is engaged in the first part 100, these two parts being connected together by a hinge 150.

In the present embodiment, the axis X of the stem 40 is rectilinear, but it could be curved in an alternate embodiment.

Further as shown in FIG. 1, the container 20 comprises a neck 21 in its upper part and inserted in the neck 21 of the container 20 is a wiper 24 for wiping off excess product from the applicator 30.

The stem 40 is provided at its proximal end 52 with a gripping element 54 that also forms a cap for leak tight closure of the container 20. The cap 54 of the applicator 30 has threads 32 which can be screwed onto threads 22, formed on a neck 21 of the container 20.

The distal end 50 of the stem 40 includes an interior longitudinal space for receiving a mounting end piece 82 of the applicator member 80.

The cosmetic applicator 30 may be used to apply the product (not shown) including a cosmetic or care product. The cosmetic or care product includes viscous cosmetics, mascara, eyebrow powder, lip gloss, hair color, skin care, under eye cosmetics, pharmaceutical and like products.

In the present embodiment and as seen in FIGS. 2-5, the applicator head 90 extends along a longitudinal axis A and is attached to an end piece 82. The latter is fanned by two half end pieces 82*a* and 82*b* that are in contact with one another and connected together by the hinge 150.

Each of two half end pieces 82*a* and 82*b* are connected to the first part 100 and to the second part 120, respectively. The end piece 82 can be held in the stem 40 by any means, in particular by adhesive bonding, force-fitting, stapling, screw-fastening, crimping or snap-fastening.

In present embodiment, the end piece 82 is in the form of a cylinder of revolution in the case of mounting in a stem 40. The end piece 82 can be realized in a different manner, in particular when it is intended to serve directly for gripping.

Figure 8:
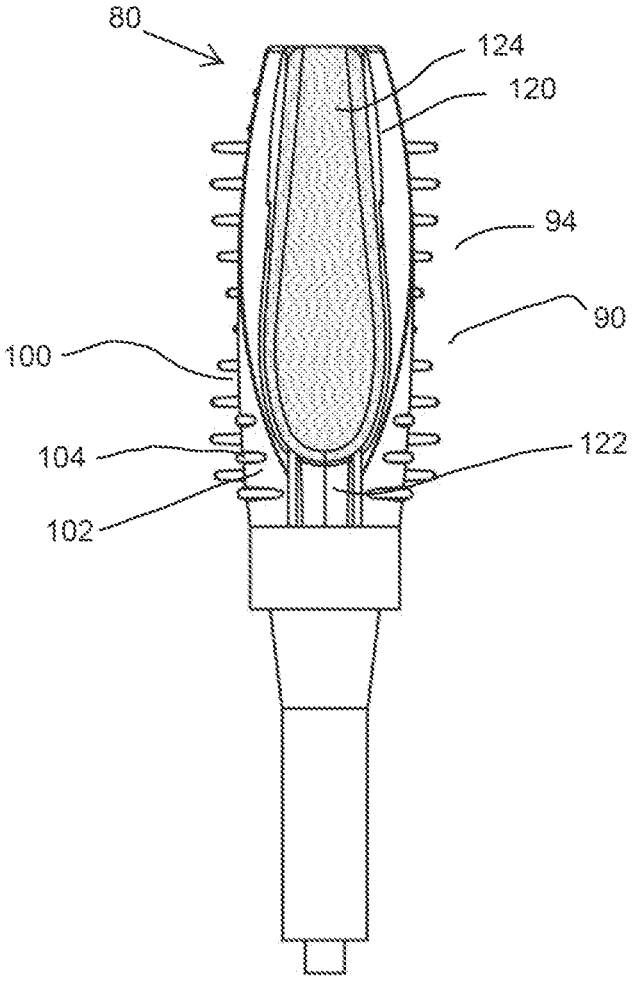
FIG. 8 shows a rear view of the applicator member of FIG. 2, with a flocked second part.
Figure 9:
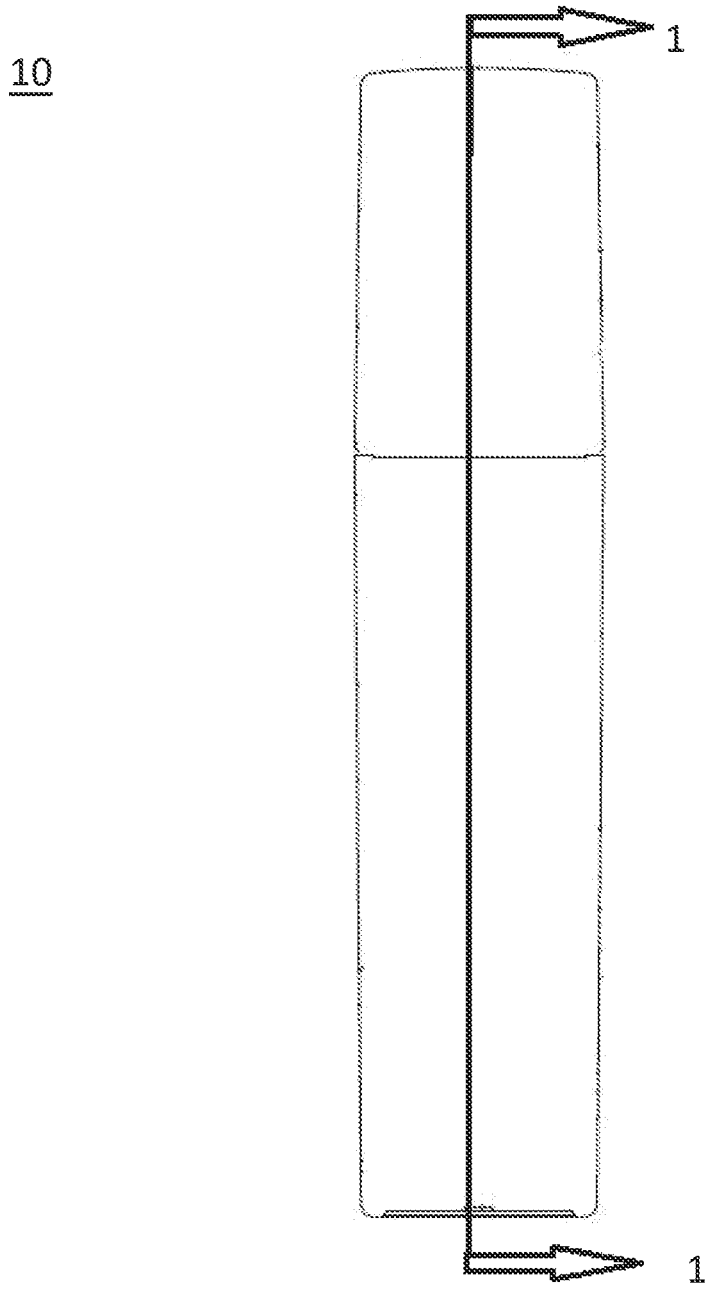
FIG. 9 shows the cosmetic package of FIG. 1 and indicates the plane on which the sectional view of FIG. 1 was taken.

As seen in FIGS. 2-5, the first part 100 comprises a plurality of application elements such as tines 104 on its outer surface 102, and the second part 120 can be flocked, as illustrated in FIG. 8. The tines 104 extend preferably perpendicularly relative to the longitudinal axis A of the applicator head 90. In an alternate embodiment, the tines 104 may extend at any other non-zero angle relative to the longitudinal axis A of the applicator head 90. The plurality of application elements is adapted to convey and apply the cosmetic product.

In variant embodiment, the plurality of application elements on the first part may include projections, bristles, particles, ribs, grooves, discs, slits, cuts, holes, dimples, or other molded features that are suitable for combing and/or loading, transporting and applying cosmetic product such as, for example, mascara, eyeshadow etc.

In still other alternate embodiment, the plurality of application elements in the form of tines or other molded features may be present on the outer surface 122 of the second part 120 of the applicator head 90 and the outer surface 102 of the first part 100 may be flocked.

Figure 7:
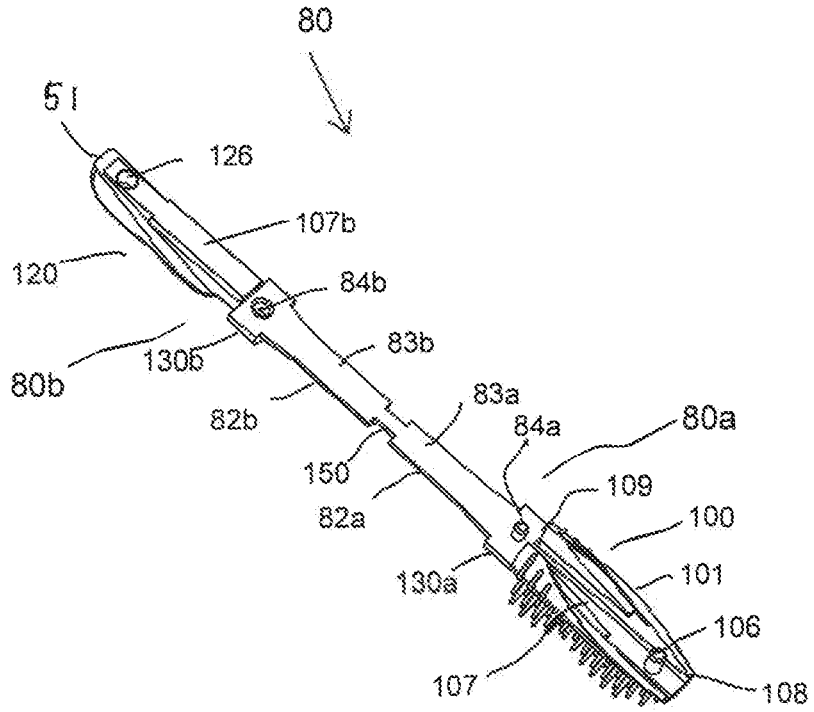
FIG. 7 shows a perspective view of the applicator member of FIG. 2 in an interim configuration.
Figure 6:
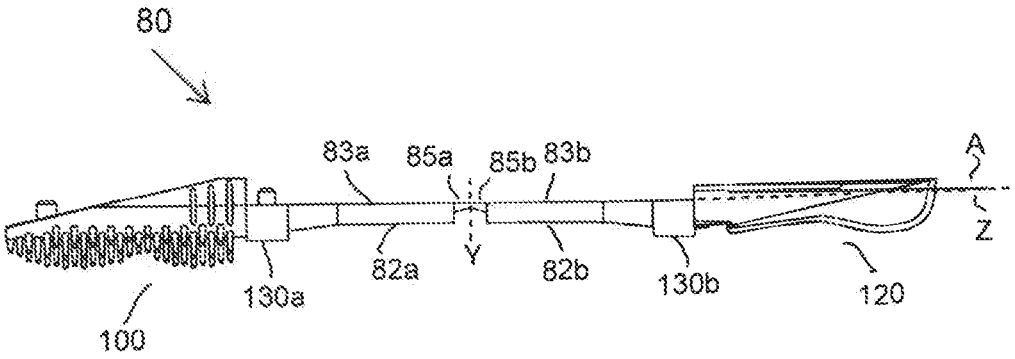
FIG. 6 shows a side view of the applicator member of FIG. 2 in an open state.

In present embodiment and as shown in FIGS. 6-7, the applicator member 80 comprises two portions namely a first portion 80*a* and a second portion 80*b*. The first portion 80*a* further comprises a first part 100 of the applicator head 90 and a first half end piece 82*a*; and the second portion 80*b* further comprises a second part 120 of the applicator head 90 and a second half end piece 82*b*. The longitudinal axis A of the applicator head 90 extends along the longitudinal axis Z of the end piece 82. In alternate embodiment, the longitudinal axis A of the applicator head 90 forms an angle of preferably less than 45°, better still between 10 and 45°, with the longitudinal axis Z of the end piece 82.

Each of the two half end pieces 82*a* and 82*b* preferably has a flat mating face 83*a* and 83*b*, the latter coming into contact with one another over their entire surface area. In a variant embodiment, these faces may comprise one or more reliefs that cooperate, for example by snap-fastening.

In present embodiment, the hinge 150 is a film hinge and is disposed at those ends 85*a* and 85*b* of the two half end pieces 82*a* and 82*b* that are away from the first and second parts 100 and 120. It allows the two parts 100 and 120 and the two half end pieces 82*a* and 82*b* to be molded in the open configuration in one piece and to be assembled by the second part 120 and the half end piece 82*b* being rotated about an axis Y of the hinge 150, perpendicular to the longitudinal axis Z of the end piece 80, as illustrated in FIGS. 6 to 7.

Further as illustrated in FIGS. 2-3 and 6-7, the first and second parts 100 and 120 can each be attached to a respective half end piece 82*a* or 82*b* by way of a corresponding intermediate portion 130*a* or 130*b* which widens in the direction of the associated part. Preferably, the intermediate portions 130*a* and 130*b* are symmetrical such that when they are folded one over the other, the applicator member 80 has no discontinuities in its portion extending between the end piece 82 and the applicator head 90.

As shown in FIG. 7, the first part 100 comprises of a curved body 101 forming a non-through cavity 107, for receiving the second part 120. Second part 120 comprises a received surface 107*b* opposite from outer surface 122 and shaped to be received into cavity 107. The cavity 107 is open only on an inner side and along an entire length of the curved body 101, such that the cavity 107 has a distal open top end 108 at the distal end of the cavity and a proximal open bottom end 109 at the proximal end of the cavity. Curved body 101 is formed by walls 101*a* and 101*b* that define a trough open at both ends.

Figure 5:
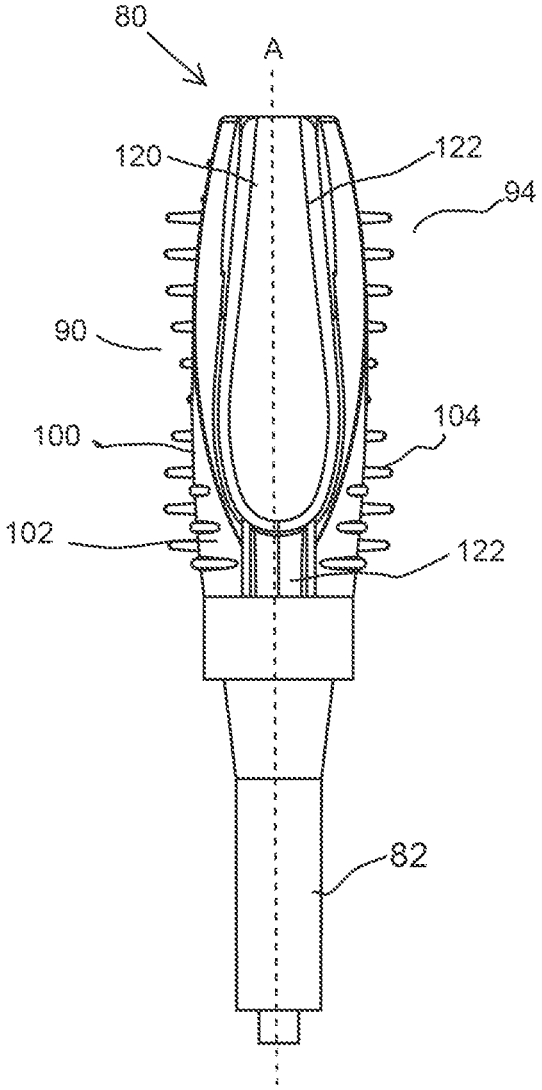
FIG. 5 shows a rear view of the applicator member of FIG. 2.
Figure 4:
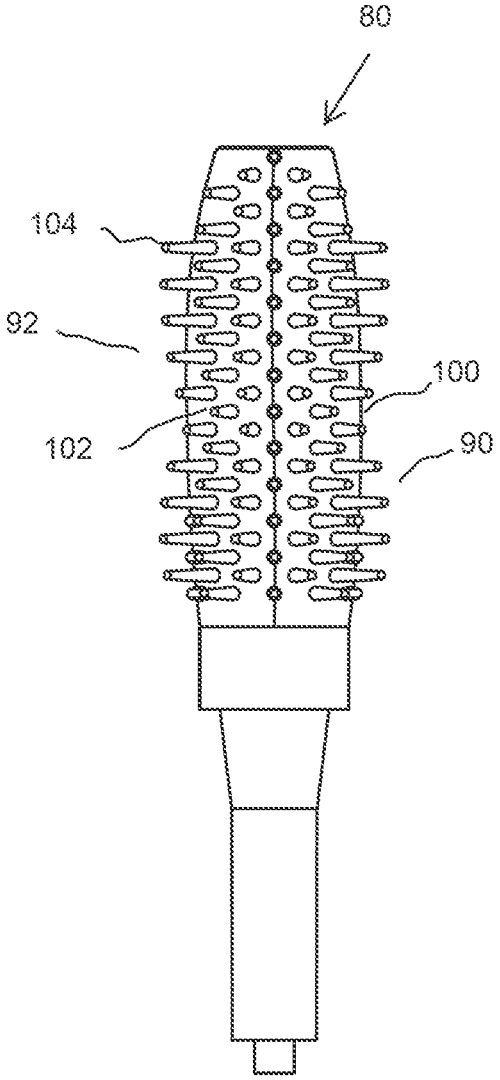
FIG. 4 shows a front view of the applicator member of FIG. 2.

Further, in the assembled state, as seen in FIGS. 4 and 5, the applicator head 90 defines two opposite main applicator faces 92 and 94.

In the assembled state, when the second part 120 is received in the first part 100, the first part 100 surrounds the second part 120 in such a way that only an outer surface 102 of the first part 100 is visible on one side of the applicator head 90, thus forming a first face 92, as can be seen in front view illustrated in FIG. 4 and the opposite side of the applicator head 90 forming a second face 94 comprises a combination of an outer surface 122 of the second part 120 and an outer surface 102 of the first part 100 as can be seen in rear view illustrated in FIG. 5. Walls 101*a*, 101*b* of curved body 101 surround the second part and provide application surfaces that extend along the edges of the second part 120.

Further, as seen in FIG. 4, one type of application elements, in present case tines 104 are accessible for use on the first face 92 of the applicator head 90. These application elements may extend from walls 101*a*, 101*b*, providing additional surface area to hold and apply cosmetic product. As seen in FIG. 8, a second type of application elements, in present case flocked fibers 124 are accessible for use on the second face 94 of the applicator head 90. Flocked fibers 124 may enable a user to smooth or blend cosmetic product that has been applied to the skin.

Figure 3:
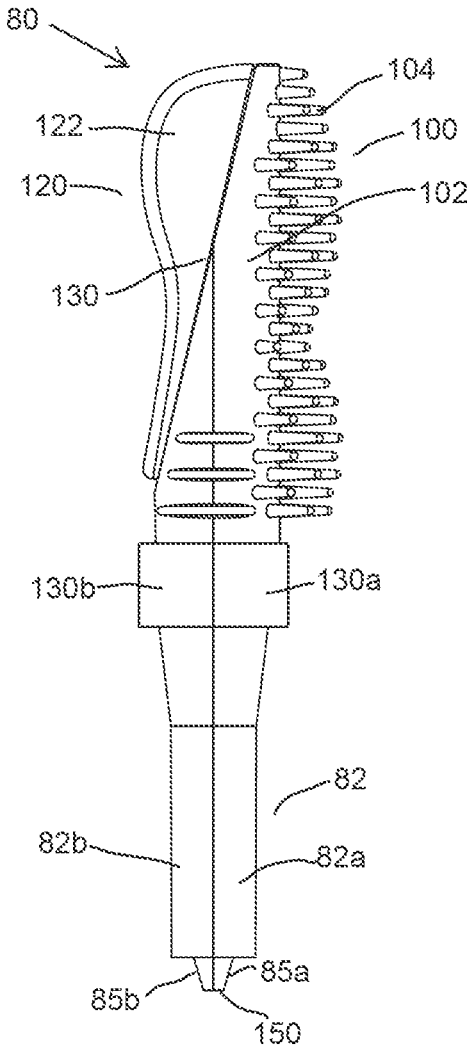
FIG. 3 shows a right side view of the applicator member of FIG. 2.
Figure 2:
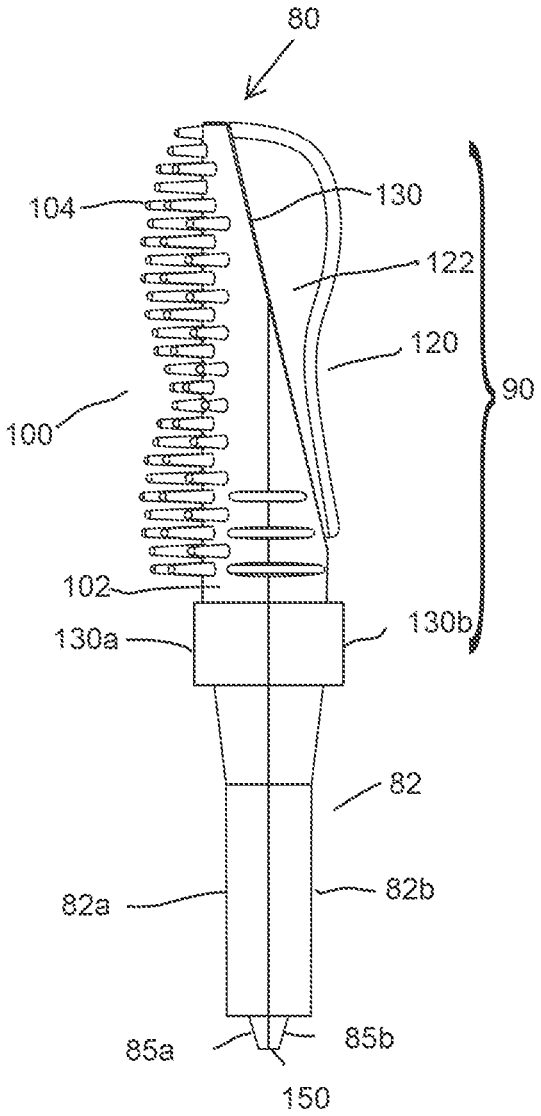
FIG. 2 shows a left side view of an applicator member of the cosmetic applicator of FIG. 1.

In the present embodiment, as seen in FIG. 7, the cavity 107 is oblique with respect to the longitudinal axis A of the applicator head 90. That is, edges of walls 101*a*, 101*b* define an oblique angle with respect to the longitudinal axis. Outer surface 122 of second part 120 is shaped to mate against the edges of walls 101*a*, 101*b*. Therefore, in the assembled state, when the second part 120 is received in the first part 100, the outer surface 102 of the first part 100 meets the outer surface 122 of the second part 120 at an interface 130 which is at a non-zero angle with respect to the longitudinal axis A of the applicator head 90, as can be seen in FIGS. 2 and 3.

As seen in FIGS. 6 and 7, the cavity 107 of the first part 100 has a protrusion 106 and the second part 120 has a corresponding groove 126.

During assembly of the applicator member 80, the second part 120 is folded over the first part 100 to receive the second part 120 in the cavity 107 of the first part 100.

As illustrated in FIG. 1, during folding of the second part 120 over the first part 100, the protrusion 106 of the first part 100 is snap-fastened into the groove 126 of the second part and a protrusion 84*a* of the first intermediate portion 130 is snap-fastened into a corresponding groove 84*b* in the second intermediate portion 130*b* in order to keep the applicator member 80 in the closed position.

In alternate embodiments, the second part 120 can comprise a protrusion that is snap-fastened into a groove in the first part 100, or it is possible for the first and the second part 100 and 120 not to have any groove for snap-fastening.

The two portions 80*a* and 80*b* can be kept in place by the insertion of the applicator member 80 into the longitudinal opening or cavity in the stem 40. The two half end pieces 82*a* and 82*b* are then clamped together.

According to an embodiment of the present disclosure, the applicator member 80 may be fabricated from a material selected from a group consisting of plastic, metal, alloy, ceramic, stone, wood, rubber, sintered or porous material and/or combinations thereof.

A cosmetic applicator may be formed according to one embodiment of the disclosure as follows. A mold is prepared to form an assembly, such as the one illustrated in FIGS. 6 and 7. The mold is shaped so that the molded piece includes a first part 100 with application elements, such as tines 104, and a second part 120, which may have a smooth surface.

The assembly shown in FIGS. 6 and 7 is formed using such a mold by a process known in the art, for example, injection molding. The assembly may be formed from a material selected from thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP), and the like.

According to one embodiment, flocking is applied to second part 120. Briefly, the fibers for flocking which may be of any commonly used material, such as nylon, polyester or any natural fiber are applied with an adhesive, such as an epoxy, to the surface to be flocked.

The flocking finish to the surface of the applying member may be achieved by an appropriately chosen known technique, such as electrostatic flocking. Preferably, the flocking process takes place in an electrostatic field, which results in the proper orientation of the fibers.

Because first and second parts 100, 120 are spatially distant from one another, processes can be applied to one part without effecting the other part. According to one embodiment, first part 100 is covered by a mask or other covering while second part 120 is flocked with fibers.

Once application elements 104, 124 are provided on first and second parts 100, 120, first part and second part are brought together by flexing hinge 150. Flat mating surfaces 83*a*, 83*b* are brought into contact. Protrusion 84*a* of first intermediate portion 130*a* fits into and engages with groove 84*b* of second intermediate portion 130*b*, for example, by a snap-fit connection. Likewise, protrusion 106 fits into and engages with groove 126. Half end pieces 82*a* and 82*b* together form mounting end piece 82. As shown in FIG. 8, molded application elements 104 of first part 100 are now adjacent to flocked surface 124 of second part 120. Because the first and second parts 100, 120 were physically separated while flocking is applied to the second part, no flocked fibers are applied to the first part. As shown in FIG. 1, mounting end piece 82 is fitted into a cavity at the distal end of stem 40.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

While the foregoing is directed to embodiments of the present disclosure, other and further embodiments of the disclosure may be devised without departing from the basic scope thereof, and the scope thereof is determined by the claims that follow.

Although, the present disclosure has been described with reference to exemplary embodiments, it is not limited thereto. Those skilled in the art will appreciate that numerous changes and modifications may be made to the preferred embodiments of the present disclosure and that such changes and modifications may be made without departing from the true spirit of the present disclosure. It is therefore intended that the appended claims be construed to cover all such equivalent variations as fall within the true spirit and scope of the present disclosure.

What is claimed is:

1. An applicator member comprising;

a first part having a substantially flat first mating face and a first applicator face, wherein the first applicator face comprises first application elements;

a second part having a substantially flat second mating face, a received face, and a second applicator face, wherein the second applicator face comprises second application elements, and wherein the received face is opposite from the second applicator face; and a hinge, wherein the hinge joins the first part to the second part, wherein, in an interim configuration, the hinge is open so that the first part and the second part are separated from one another, wherein rotation of the first and second parts about a hinge axis moves the first part and the second part into an assembled configuration so that the first and second mating faces contact one another to form an applicator head having a longitudinal axis and a connecting part for connection to a rod stem, wherein the first part further comprises a non-through cavity formed by the first applicator face and two walls extending in a direction away from the first applicator face, the two walls extending at oblique angles with respect to the longitudinal axis of the applicator head, wherein, in the assembled configuration, the received face is received in the non-through cavity between the two walls, and wherein the two walls surround the second part and provide application surfaces that extend along outside edges of the second part and such that only an outer surface of the first part is visible from a first side of the applicator member and a combination of an outer surface of the first part including the application surfaces of the two walls and the first application elements and an outer surface of the second part are visible from a second side of the applicator member opposite the first side.

2. The applicator member of claim 1, wherein the first application elements are formed by molding and the second application elements are flocking fibers applied to the second applicator face.

3. The applicator member of claim 2, wherein the first application elements are selected from one or more of tines, projections, bristles, particles, ribs, grooves, discs, slits, cuts, holes, and dimples.

4. The applicator member of claim 3, wherein the first part is free of flocking fibers.

5. The applicator member of claim 1, wherein, in the interim configuration the cavity comprises an open end longitudinally opposite from the hinge along the first part, wherein the second part comprises a distal end longitudinally opposite from the hinge along the second part, wherein, in the assembled configuration, the open end and the distal end of the second part form a distal tip of the applicator head.

6. The applicator member of claim 5, wherein, in the interim configuration, the first part further comprises a first half end piece longitudinally opposite from the open end along the first part and connected with the hinge, wherein the second part further comprises a second half end piece longitudinally opposite from the distal end of the second part along the second part and connected with the hinge, and wherein, in the assembled configuration, the first and second half end pieces together form a mounting end piece.

7. The applicator member of claim 1, wherein the cavity extends along a longitudinal axis of the first part and wherein the cavity is open at a proximal end and a distal end.

8. The applicator member of claim 7, wherein the walls each comprise first edges opposite from the first applicator face, wherein the second mating face comprises second edges arranged to contact the first edges in the assembled configuration, and wherein, in the assembled configuration the first and second edges define a linear interface at an oblique angle to the longitudinal axis.

9. The applicator member of claim 1, wherein the first and second mating faces further comprise one or more interlocking structures, wherein, when the applicator member is moved from the interim configuration to the assembled configuration, the interlocking structures fix the first part with the second part.

10. The applicator member of claim 9, wherein the interlocking structure comprises a protrusion on one of the first and second mating faces and a receiving groove on another of the first and second mating faces.

11. The applicator member of claim 9, wherein the interlocking structure comprises a snap fit connection.

* * * * *